US008316826B2

(12) United States Patent
Coldren et al.

(10) Patent No.: US 8,316,826 B2
(45) Date of Patent: Nov. 27, 2012

(54) REDUCING VARIATIONS IN CLOSE COUPLED POST INJECTIONS IN A FUEL INJECTOR AND FUEL SYSTEM USING SAME

(75) Inventors: Dana R. Coldren, Secor, IL (US); Fergal M. O'Shea, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 986 days.

(21) Appl. No.: 12/321,065

(22) Filed: Jan. 15, 2009

(65) Prior Publication Data

US 2010/0175670 A1 Jul. 15, 2010

(51) Int. Cl.
*F02M 51/06* (2006.01)

(52) U.S. Cl. ..... 123/490

(58) Field of Classification Search ..... 123/472, 123/490; 239/89, 533.9, 533.2, 585.1
See application file for complete search history.

(56) References Cited

U.S. PATENT DOCUMENTS

| | | | | |
|---|---|---|---|---|
| 4,327,345 | A | 4/1982 | Kelso et al. | |
| 5,088,467 | A | 2/1992 | Mesenich | |
| 5,381,999 | A | 1/1995 | Ricco | |
| 5,540,564 | A | 7/1996 | Klopfer | |
| 5,947,442 | A | 9/1999 | Shurman et al. | |
| 6,126,094 | A | 10/2000 | Ricco | |
| 6,758,419 | B2 | 7/2004 | Yildirim et al. | |
| 6,764,061 | B2 | 7/2004 | Haeberer et al. | |
| 6,793,196 | B2 | 9/2004 | Van Weelden et al. | |
| 6,796,543 | B2 | 9/2004 | Haeberer et al. | |
| 6,830,018 | B2 | 12/2004 | Sugimoto et al. | |
| 6,976,474 | B1 | 12/2005 | Coldren et al. | |
| 7,080,819 | B2 | 7/2006 | Tojo | |
| 7,156,368 | B2 | 1/2007 | Lucas et al. | |
| 7,354,027 | B2 | 4/2008 | Mennicken et al. | |
| 7,866,301 | B2 * | 1/2011 | Venkataraghavan et al. | 123/472 |
| 8,074,903 | B2 * | 12/2011 | Venkataraghavan et al. | 239/585.2 |
| 2007/0095955 | A1 | 5/2007 | Hoffmann et al. | |

* cited by examiner

*Primary Examiner* — Hai Huynh
(74) *Attorney, Agent, or Firm* — Liell & McNeil

(57) ABSTRACT

An electrically controlled fuel injector includes an armature that is movable between a first armature position and a second armature position inside an armature cavity containing fuel. By reducing the size of the armature cavity to a squish film drag gap, the armature experiences a squish film drag phenomenon when the armature moves from the first armature position to the second armature position reducing the armature travel speed but also reducing the settling time of the armature after an injection event. By reducing the armature travel speed, the armature experiences a reduction in magnitude of armature bounce allowing the armature to settle down quicker and produce minimum controllable injection events with shorter dwell times than predecessor fuel injectors, especially for close coupled post injection events.

20 Claims, 5 Drawing Sheets

REDUCING VARIATIONS IN CLOSE COUPLED POST INJECTIONS IN A FUEL INJECTOR AND FUEL SYSTEM USING SAME

TECHNICAL FIELD

The present disclosure relates generally to fuel injector systems, and in particular, to a squish film drag strategy to reduce variations in close coupled post injections.

BACKGROUND

Mechanically actuated electronically controlled unit injectors (MEUI) have seen great success in compression ignition engines for many years. In recent years, MEUI injectors have acquired additional control capabilities via a first electrical actuator associated with a spill valve and a second electrical actuator associated with a direct operated nozzle check valve. MEUI fuel injectors are actuated via rotation of a cam, which is typically driven via appropriate gear linkage to an engine's crankshaft. Fuel pressure in the fuel injector will generally remain low between injection events. As the cam lobe begins to move a plunger, fuel is initially displaced at low pressure to a drain via the spill valve for recirculation. When it is desired to increase pressure in the fuel injector to injection pressure levels, the first electrical actuator is energized to close the spill valve. When this is done, pressure quickly begins to rise in the fuel injector because the fuel pumping chamber becomes a closed volume when the spill valve closes. Fuel injection commences by energizing the second electrical actuator to relieve pressure on a closing hydraulic surface associated with the direct operated nozzle check valve. The closing hydraulic surface of the directly operated nozzle check valve is located in a needle control chamber which is alternately connected to the pumping chamber or a low pressure drain by moving a control valve assembly with the second electrical actuator. Such a control valve structure is shown, for example, in U.S. Pat. No. 6,889,918. The nozzle check valve can be opened and closed any number of times to create an injection sequence consisting of a plurality of injection events by relieving and then re-applying pressure onto the closing hydraulic surface of the nozzle check valve. These multiple injection sequences have been developed as one strategy for burning the fuel in a manner that reduces the production of undesirable emissions, such as NOx, unburnt hydrocarbons and particulate matter, in order to relax reliance on an exhaust aftertreatment system.

One multiple injection sequence that has shown the ability to reduce undesirable emissions includes a relatively large main injection followed closely by a small post injection. Because the nozzle check valve must inherently be briefly closed between the main injection event and the post-injection event, pressure in the fuel injector may surge due to the continued downward motion of the plunger in response to continued cam rotation. In addition, past experience suggests that conditions within the fuel injector immediately after a main injection event are highly dynamic, unsettled and somewhat unstable, making it difficult to controllably produce a small post injection quantity. If the dwell is too short, the post injection quantity is too variant. If the dwell between the main injection event and the post-injection event is too long, the increased pressure in the fuel injector may undermine the ability to produce small post injection quantities, but the more stable environment renders the post injection more controllable. In other words, the longer the dwell, the larger the post injection pressure coupled with greater controllability. Thus, the inherent structure and functioning of MEUI injectors makes it difficult to control fuel pressure during an injection sequence because the fuel pressure is primarily dictated by plunger speed (engine speed) and the flow area of the nozzle outlets, if they are open, but the potentially unstable time period immediately after main injection makes any post injection quantity more variable and less predictable. As expected, the pressure surging problem as well as the shrinking post injection timing window can become more pronounced at higher engine speeds and loads, which may be the operational state at which a closely coupled small post injection is most desirable. The inherent functional limitations of known MEUI systems may prevent small close coupled post injections both in desired quantity and timing relative to the end of the preceding main injection event in order to satisfy ever more stringent emissions regulations.

The problems set forth above are not limited solely to MEUI systems. Rather, most electronically controlled fuel injector systems including common rail systems, cam actuated systems and hydraulically actuated systems face these problems as well. U.S. Pat. No. 7,354,027 teaches the use of a damping chamber and a damping face, whose angle is altered to control the amount of damping in order to reduce armature bounce between the armature and the stator assembly. The prior art fails to appreciate that the armature bounce occurring when the armature is at its farthest point from the stator assembly may also play a significant role in close coupled post injections.

The present disclosure is directed to overcoming one or more of the problems set forth above.

SUMMARY

In one aspect, a fuel injector includes an injector body defining a nozzle outlet. A solenoid assembly includes a stator assembly that has a bottom stator surface, and an armature that has a top armature surface and a bottom armature surface. The stator assembly is closer to the top armature surface than the bottom armature surface. An electronically controlled control valve assembly includes a control valve member attached to the armature. The armature is movable between a first armature position and a second armature position inside an armature cavity that is defined by an inner surface of the injector body. A spring biases the armature away from the stator assembly towards the second armature position. A final air gap is a distance between the top armature surface and the bottom stator surface when the armature is in the first armature position. A final squish film drag gap is a distance between the bottom armature surface and an inner surface of the injector body when the armature is in the second armature position. The final squish film drag gap is about the same order of magnitude as the final air gap.

In another aspect, a method of operating a fuel injector includes initiating an injection event by energizing a solenoid assembly to move an armature inside an armature cavity from a second armature position to a first armature position, which is a final air gap away from a bottom stator surface of a stator assembly. The injection event ends by de-energizing the solenoid assembly to move the armature inside the armature cavity from the first armature position to the second armature position, which is a final squish film drag gap away from an inner surface of an injector body. Ending the injection event includes squish film dragging the motion of the armature when the armature moves from the first armature position to the second armature position. Squish film dragging the motion of the armature includes setting a final squish film drag gap to about the same order of magnitude as the final air gap.

In yet another aspect, a fuel system includes a rotatable cam and a mechanical electronic unit fuel injector actuated via rotation of the cam. The mechanical electronic unit fuel injector includes an injector body defining a nozzle outlet. The first electrical actuator is operably coupled to a spill valve and a second electrical actuator is operably coupled to control pressure in a needle control chamber. A solenoid assembly includes a stator assembly that has a bottom stator surface and an armature assembly that has a top armature surface and a bottom armature surface. The stator assembly is closer to the top armature surface than the bottom armature surface. An electronically controlled control valve assembly includes a control valve member attached to the armature. The armature is movable between a first armature position and a second armature position inside an armature cavity defined by an inner surface of the injector body. A spring biases the armature towards the second armature position. A final air gap is a distance between the top armature surface and the bottom stator surface when the armature is in the first armature position. A final squish film drag gap is a distance between the bottom armature surface and an inner surface of the injector body when the armature is in the second armature position. The final squish film drag gap is about the same order of magnitude as the final air gap.

DETAILED DESCRIPTION

The present disclosure relates to a fuel injector having a squish film drag gap to slow armature movement compared to faster large gap predecessor fuel injectors, thereby allowing the fuel injector to counter-intuitively perform smaller close coupled post injection following a main injection event with more predictable and less variable injection quantities and timings. The present disclosure also provides the choice of performing injection sequences with smaller minimum controllable injection event durations than produced by predecessor fuel injectors.

Figure 1:
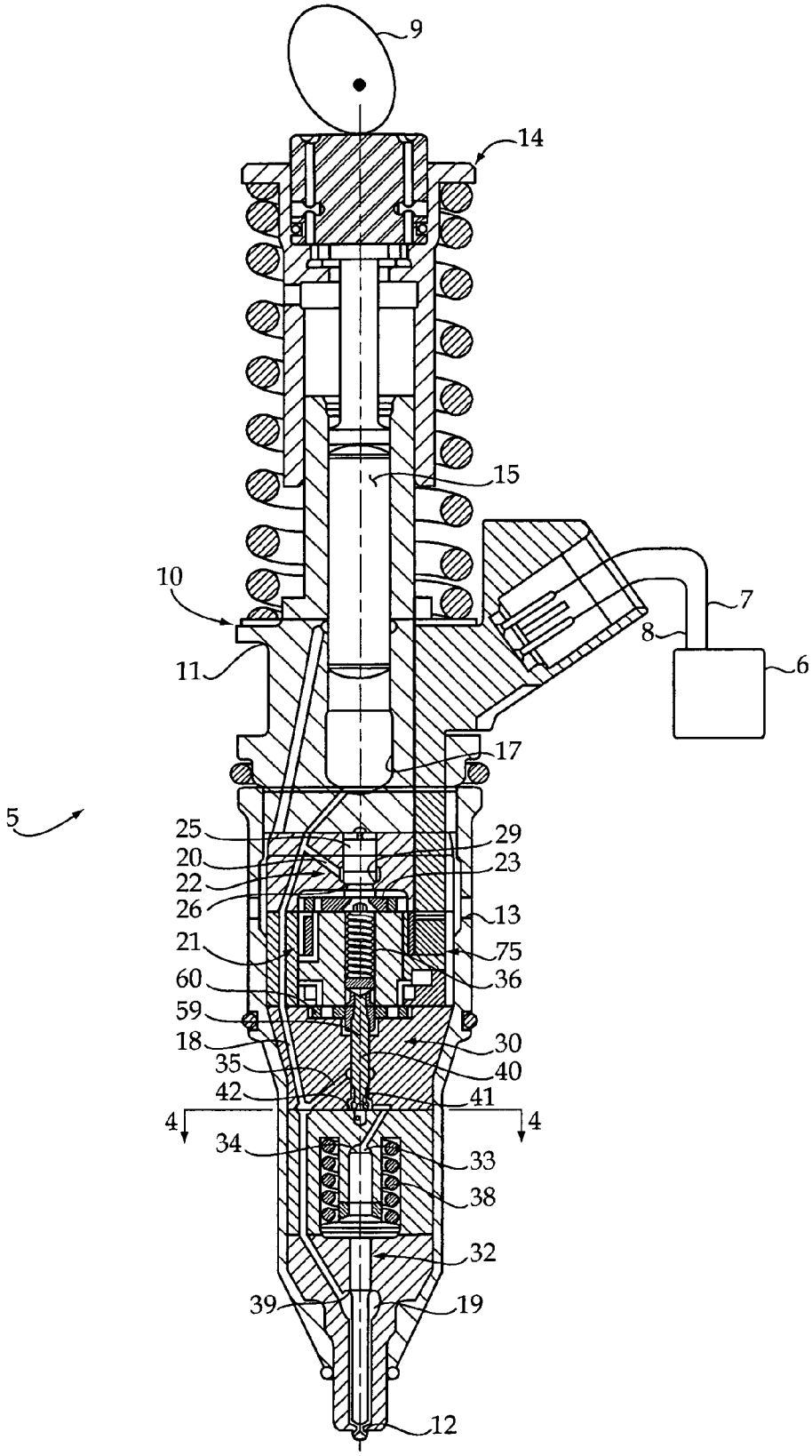
FIG. 1 is a side sectioned diagrammatic view of a fuel injector according to one aspect of the present disclosure.
Figure 2:
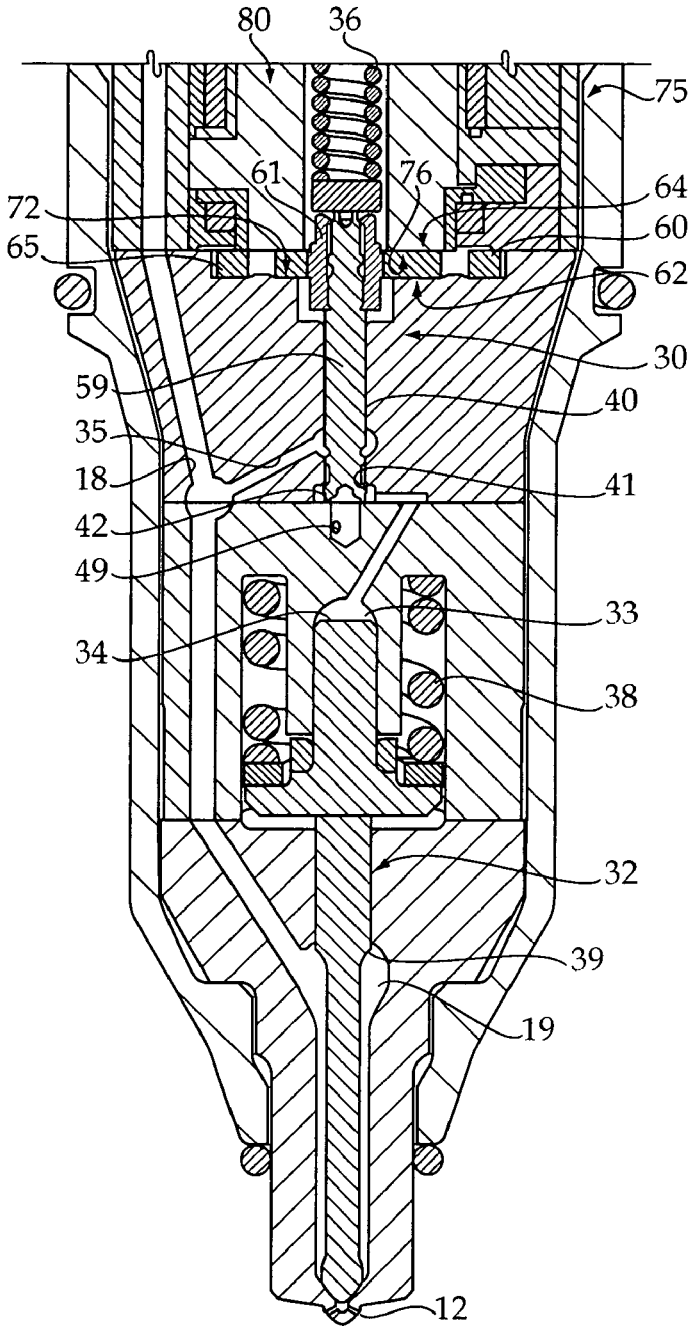
FIG. 2 is an enlarged side sectioned diagrammatic view of the armature cavity and control valve assembly portion of the fuel injector shown in FIG. 1.

Referring to FIGS. 1 and 2, a fuel system 5 includes a mechanical electronic unit fuel injector 10 that is actuated via rotation of a cam 9 and controlled by an electronic controller 6. Fuel injector 10 includes a first electrical actuator 21 operably coupled to a spill valve 22, and an electrically actuated solenoid assembly 75 that includes a stator assembly 80 having a bottom stator surface 76 and an armature 60 having a top armature surface 64 and a bottom armature surface 62. The first electrical actuator 21 and the electrically actuated solenoid assembly 75 are energized and de-energized via control signals communicated from electronic controller 6 via communication lines 7 and 8, which may be wireless.

Fuel injector 10 includes an injector body 11 made up of a plurality of components that together define several fluid passageways and chambers. In particular, a pumping chamber 17 is defined by injector body 11 and a cam driven plunger 15. When plunger 15 is driven downward due to rotation of cam 9 acting on tappet 14, fuel is displaced into a spill passage 20, past spill valve 22, and out a drain passage (not shown) that is fluidly connected to fuel supply/return opening 13. As shown, tappet 14 extends outside of injector body 11. When first electrical actuator 21 is energized, a spill valve member 25 is moved with an armature 23 until a valve surface 26 comes in contact with an annular valve seat 29 to close spill passage 20. When this occurs, fuel pressure in pumping chamber 17 increases, as well as a fuel pressure in nozzle chamber 19 via the fluid connection provided by nozzle supply passage 18. Spill valve member 25 is normally biased to a fully open position via a compression biasing spring 36.

The control valve assembly 30 includes the control valve member 40, which is attached to the armature 60 and moves between a high pressure conical valve seat 41 and a low-pressure flat valve seat 42 when the armature 60 moves between a second armature position and a first armature position, respectively. For the sake of brevity, the armature 60 and the control valve member 40 may collectively be referred to as the armature assembly 59. In one embodiment, the armature assembly 59 may further include a guide piece 61 that connects the armature 60 to the control valve member 40. Biasing spring 36 also serves to bias the armature 60 away from the stator assembly 80 towards the second armature position and bias the control valve assembly 30 to a closed configuration.

The fuel injector 10 also includes a direct controlled nozzle check valve 32 that has an opening hydraulic surface 39 exposed to fluid pressure inside a nozzle chamber 19 and a closing hydraulic surface 34 exposed to fluid pressure inside a needle control chamber 33. The electrically actuated solenoid assembly 75 controls the movement of the armature 60 between the first armature position, which is a final air gap (See 69 in FIG. 3*b*) away from the bottom stator surface 76 of the stator assembly 80 and the second armature position, which is a final squish film drag gap (See 68 in FIG. 3*b*) away from the inner surface 72 of the injector body 11. The control valve member 40, which is attached to the armature 60, is movable between the high-pressure conical valve seat 41 and the low-pressure flat valve seat 42, which corresponds to a movement of the direct controlled nozzle check valve 32 between an open configuration and a closed configuration, respectively.

When the electrically actuated solenoid assembly 75 is de-energized, the armature 60 is in the second armature position, the control valve member 40 is seated at the low-pressure flat valve seat 42 and the control valve assembly 30 is in the closed configuration. The control valve assembly 30 fluidly blocks the needle control chamber 33 from a low-pressure drain passage 49, and fluidly connects to pressure connection passage 35, which is fluidly connected to nozzle supply passage 18. Pressure in the needle control chamber 33 acts upon the closing hydraulic surface 34 associated with nozzle check valve 32. As long as pressure in needle control chamber 33 is high, nozzle check valve 32 will remain in, or move toward, a closed configuration, blocking nozzle outlets 12.

When the electrically actuated solenoid assembly 75 is energized, the armature 60 is in the first armature position, the control valve member 40 is seated at the high-pressure conical valve seat 41 and the control valve assembly 30 is in the open configuration and fluidly connects needle control chamber 33 to the low-pressure drain 49. Pressure in needle control chamber 33 is reduced and the nozzle check valve 32 will remain in, or move towards, an open configuration, allowing fuel inside the nozzle chamber 19 to flow through the nozzle outlets 12, if fuel pressure is above a valve opening pressure sufficient to overcome spring 38. The armature 60 has an armature travel distance defined by the distance between the first armature position and the second armature position. The nozzle check valve 32 has a nozzle check valve travel distance defined by the distance the nozzle check valve 32 travels between the open configuration and the closed configuration. The nozzle check valve travel distance may be larger than the armature travel distance, and in one embodiment, the nozzle check valve travel distance is about an order of magnitude larger than the armature travel distance.

Figure 3A:
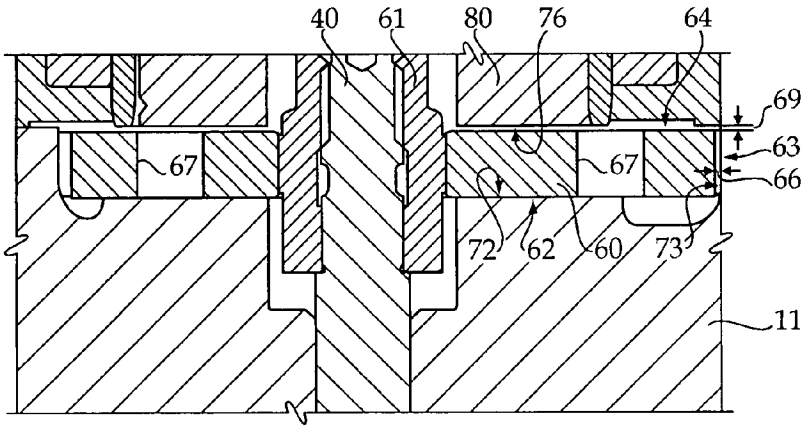
FIG. 3*a* is a further enlarged side sectioned diagrammatic view of the armature assembly of the fuel injector shown in FIG. 1.
Figure 3B:
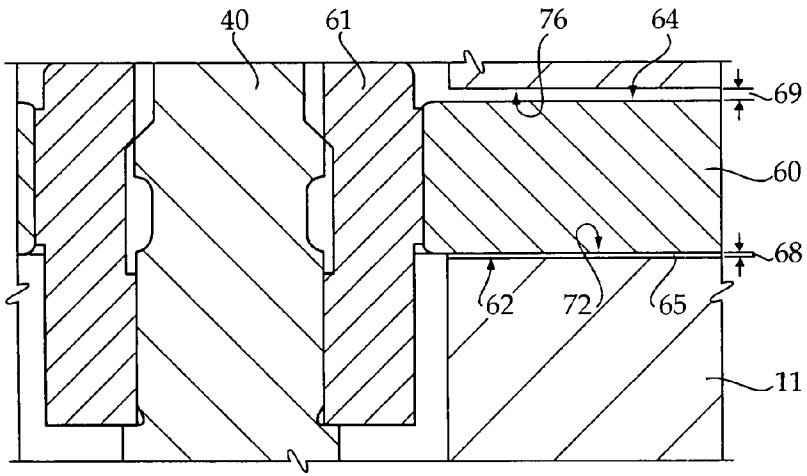
FIG. 3*b* is an even further enlarged side sectioned diagrammatic view of the armature cavity shown in FIG. 3*a;*

Referring more specifically to FIGS. 3*a* and 3*b*, the present embodiment shows an armature 60 disposed in armature cavity 65 partially defined by the inner surface 72 of the injector body 11 and an inner side wall 73 of the injector body 11. Both the top and bottom armature surfaces 64 and 62 may be planar and may lie parallel to the bottom stator surface 76 of the stator assembly 80 and the inner surface 72 of the injector body 11, respectively. The top armature surface 64 of the armature 60 is closer to the bottom stator surface 76 of the stator assembly 80 than the bottom armature surface 62 of the armature 60, which is closer to the inner surface 72 of the injector body 11 than the top armature surface 64. When in operation, the armature cavity 65 is filled with low-pressure fuel.

The fuel injector further includes a squish film drag gap 68 and an air gap 69, which are fluidly connected via a clearance gap 66 and holes 67. A clearance gap 66 is defined between outer side 63 of armature 60 and the inner side wall 73 of the injector body 11. Those skilled in the art may recognize that the clearance gap 66 should be sized such that the clearance gap 66 does not affect the flow of fuel that moves through the clearance gap 66, adversely affecting the motion of the armature 60. A clearance gap 66 that is too small may restrict the flow of fuel from the squish film drag gap 68 to the air gap 69, thereby adversely affecting the motion of the armature 60 in an unpredictable manner.

The squish film drag gap 68 is the distance between the bottom armature surface 62 and the inner surface 72 of the injector body 11 and the air gap 69 is the distance between the top armature surface 64 and the bottom stator surface 76 of the stator assembly 80. Both the squish film drag gap 68 and the air gap 69 vary in size as the armature moves between the first and second armature positions. Moreover, the sum of the size of the air gap and the squish film drag gap is fixed, such that when the squish film drag gap 68 is reduced by a certain amount, the air gap 69 increases by the same certain amount. Therefore, as the armature 60 reduces the squish film drag gap 68, the volume of the air gap 69 increases and pressure in the air gap 69 decreases.

A final air gap 69 is the distance between the top armature surface 64 and the bottom stator surface 76 of the stator assembly 80 when the armature 60 is in the first armature position. A final squish film drag gap 68 is the distance between the bottom armature surface 62 and the inner surface 72 of the injector body 11 when the armature 60 is in the second armature position and the final squish film drag gap 68 is about the same order of magnitude as the final air gap 69. In the present embodiment, the final squish film drag gap is set to about the same order of magnitude as the final air gap, such that the armature 60 experiences squish film dragging when the armature moves from the first armature position to the second armature position.

The term "about" means that when a number is rounded to a like number of significant digits, the numbers are equal. Thus both 0.5 and 1.4 are about equal. The term "same order of magnitude" means that one is less than ten times the other. 10 and 90 are the same order of magnitude but 10 and 110 are not. Therefore, for instance, if the final air gap is 50 microns and the final squish film drag gap is the same order of magnitude as the final air gap, the final squish film drag gap could lie anywhere from 5.1 to 499 microns. In one embodiment, the final squish film drag gap 68 is about twice the size of the armature travel distance. Furthermore, in one embodiment, both the final squish film drag gap 68 and the final air gap 69 are about 50 microns. In another embodiment, the final squish film drag gap 68 is about 25 microns and the final air gap 69 is about 50 microns.

For years, manufacturers have designed fuel injectors with ever smaller final air gaps to improve armature control. Therefore, in the present disclosure, the armature may be expected to experience squish film dragging when the armature approaches both the first armature position as well as the second armature position because the fuel injector has a final air gap and a final squish film drag gap of about the same order of magnitude. In predecessor fuel injectors that had final air gaps that were about 50 microns, the armature may have experienced squish film dragging as the armature neared the first armature position. However, because of the increased magnetic force acting on the armature from the solenoid assembly, the effect of squish film dragging may have had only a secondary effect, if any, on the motion of the armature. The squish film dragging may have been likely to be coincidental as some armatures in predecessor fuel injectors included grooves on the top surface of the armature that would inhibit any effect the squish film dragging had during the motion of the armature. However, in one embodiment of the present disclosure, a fuel injector may experience squish film dragging as the armature moves from the second armature position to the first armature position, as well as from the first armature position to the second armature position. In the illustrated embodiment, the squish film drag effect is reduced due to presence of holes through the armature that makes displacement of fuel during armature movement easier. Thus, the squish film drag effect might be tuned via the size of the final air gap 69, no planar surface feature on the armature, and even via holes (size, number and location) through the armature.

Figure 4:
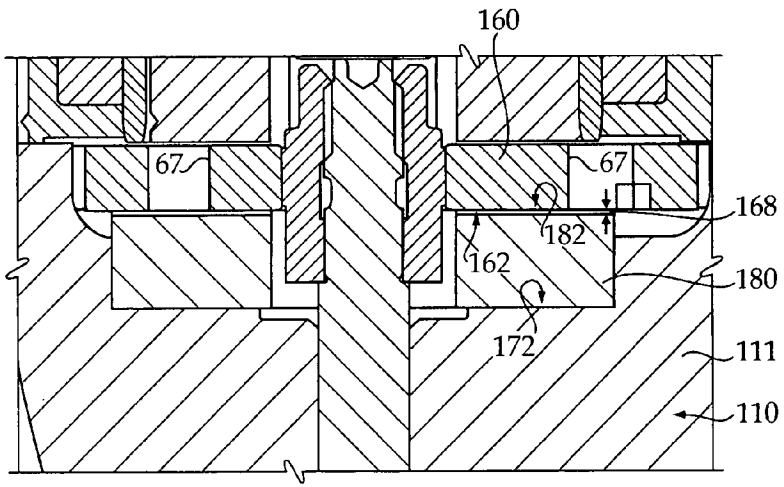
FIG. 4 is an enlarged side sectioned diagrammatic view of an armature cavity in an alternate embodiment of the present disclosure.

FIG. 4 is an alternate embodiment of the fuel injector shown in FIG. 3. A fuel injector 110 includes an injector body 111 and a drag gap spacer 180. The drag gap spacer 180 is stacked on top of the inner surface 172 of the injector body 111, such that a top surface 182 of the drag gap spacer 180 and the bottom armature surface 162 of the armature 160 partially define the squish film drag gap 168. The final squish film drag gap 168 may be set to a desired size by stacking a drag gap spacer 180 having a known, pre-determined thickness. This strategy may be desirable for reducing variations in the size of the squish film drag gap among mass produced fuel injectors. Those skilled in the art will appreciate that the diameter of drag gap spacer 180 may need to be sized sensitive to a parallelism tolerance relative to armature 160.

In the present disclosure, fuel inside the squish film drag gap 68 resists the motion of the armature 60 as the armature 60 moves from the first armature position to the second armature position. As the bottom armature surface 62 exerts a downward force on the fuel inside the squish film drag gap 68, the fuel inside the squish film drag gap 68 is being exposed to pressure exerted by the armature 60 causing the fuel to move towards a region having lower pressure. Because the volume in the air gap 69 is increasing as the volume of the squish film drag gap 68 is decreasing, the pressure in the air gap 69 decreases while the pressure in the squish film drag gap 68 increases causing fuel from the squish film drag gap 69 to escape to the air gap via the clearance gap 66 and holes 67. As the squish film drag gap 68 becomes smaller, the fuel inside the squish film drag gap 68 offers a greater resistive force to the motion of the armature 60 further increasing the deceleration on the armature 60, thereby reducing the speed of the armature quicker. Thus the valve's speed is reduced as it approaches its seat, reducing a tendency to bounce.

Squish film dragging may be understood by imagining moving two parallel planes towards each other in a fluid. As the planes are moved closer, the fluid between the planes offers some resistance to the motion. As the planes come closer, more force is required to move the planes the same distance because the fluid offers a greater resistance. When the planes are very close together, a much larger force is needed to bring the planes together. Now imagine that the force being applied to the planes is constant and the planes were moving towards each other inside the volume of fluid. As they got closer, the resistive force of the fluid got larger causing the planes to slow down. A graphical representation of the phenomenon is discussed later in relation to FIG. 5*a*.

Applying the plane concept to the motion of the armature 60 inside the squish film drag gap 68, the armature 60 is one of the planes and the inner surface 72 of the injector body 11 is the other plane. The armature 60 is being pushed by the force exerted by the biasing spring 36, while the inner surface 72 of the injector body 11 experiences no external pushing force. As the armature 60 gets closer to the inner surface 72 and the squish film drag gap 68 is becoming smaller, the armature gradually slows down. Furthermore, the amount of deceleration in the armature 60 increases as the thickness of the squish film drag gap 68 decreases causing the armature 60 to decelerate quicker as the armature 60 moves closer to the second armature position.

An injection sequence that includes a main injection event followed by a small, closely coupled post injection event helps improve combustion efficiency. The settling time and the armature travel speed of the armature may affect a fuel injector's ability to perform a small, closely coupled post injection event. Varying the size of the final squish film drag gap 68 alters the armature travel speed, and consequently the settling time of the armature 60. A dwell time between two injection events includes a travel time and a settling time. The travel time is the time the armature takes to move from one armature position to an other armature position. The settling time is the time the armature takes to come to rest at the second armature position after the travel time. The present disclosure reduces the sum of the travel time and settling time via a slight increase in travel time summed with a substantially smaller settling time. This permits shorter dwell times between injection events.

Industrial Applicability

The present disclosure finds potential application to any fuel system including a fuel injector having an armature controlled nozzle check valve and a particular application to any fuel system including a mechanically actuated electronically controlled fuel injector with at least one electrical actuator operably coupled to a spill valve and a nozzle check valve. Although both the spill valve and the nozzle check valve may be controlled with a single electrical actuator within the intended scope of the present disclosure, a typical fuel injector according to the present disclosure includes a first electrical actuator associated with the spill valve and a second electrical actuator associated with the nozzle check valve. Any electrical actuator may be compatible with the fuel injectors of the present disclosure, including solenoid actuators as illustrated, but also other electrical actuators including piezo actuators. The present disclosure finds particular suitability in compression ignition engines that benefit from an ability to produce injection sequences that include a relatively large main injection followed by a closely coupled small post-injection, especially at higher speeds and loads in order to reduce undesirable emissions at the time of combustion rather than relying upon after-treatment systems. The present disclosure also recognizes that every fuel injector exhibits a minimum controllable injection event duration, below which behavior of the injector becomes less predictable and more varied.

The minimum controllable injection event duration for a given fuel injector relates to that minimum quantity of fuel that can be repeatedly injected with the same control signal without substantial variance. This phenomenon recognizes that in order to perform an injection event, certain components must move from one position and then back to an original position with some predictable repeated behavior in order to produce a controllable event. When the durations get too small, pressure fluctuations are too large and components are less than settled, components tend to exhibit erratic behavior due to flow forces, pressure dynamics and possibly mechanical bouncing before coming to a stop, which may give rise to nonlinear and erratic behavior at various short and small quantity injection events.

The present disclosure is primarily associated with the minimal controllable injection event, especially when such an event occurs after a large main injection event. Thus, the present disclosure recognizes that simply decreasing the duration of the post-injection event may theoretically produce a smaller injection quantity, but the uncontrollable variations on that quantity may become unacceptable, thus defeating that potential strategy for producing ever- smaller injection event quantities.

Those skilled in the art may appreciate that one way of improving combustion efficiency is to perform an injection sequence that includes a large main injection 94 and a closely coupled small post injection 95. Any injection sequence generally begins when the lobe of cam 9 starts to move plunger 15. As plunger 15 begins moving, first electrical actuator 21 is energized to close spill valve 22. As cam 9 continues to rotate, pressure in nozzle chamber 19 begins to ramp up. The spill valve 22 is closed by the movement of spill valve member 25 from a fully open position 60 to a closed position 61. At this time, second electrical actuator 31 remains de-energized to facilitate a fluid connection via pressure connection passage 35 and pressure communication passage 44 to needle control chamber 33 so that the pressure therein tracks closely with the pressure increase in the nozzle chamber 19. After spill valve member 25 comes to rest at the closed position, the current or control signal to electrical actuator 21 may be dropped to a hold-in level that is sufficient to hold spill valve member 25 in the fully closed position 61.

In order to initiate the main injection event, the electrically actuated solenoid assembly 75 is energized, the armature 60 is moved from the second armature position to the first armature position due to the magnetic force exerted by the energized solenoid assembly 75. Although biasing spring 36 exerts a force opposing the magnetic force exerted by the solenoid assembly 75, the armature 60 still moves from the second armature position to the first armature position. As the armature 60 moves towards the first armature position, the control valve member 40 moves towards the high pressure conical valve seat 41, allowing fuel to move from the needle control chamber 33 to the low pressure drain passage 49, thereby relieving pressure acting on the closing hydraulic surface 34 of the nozzle check valve 32 inside the needle control chamber 33. As the pressure is relieved, the nozzle check valve 32 moves towards the open configuration, allowing fuel to flow through the unblocked nozzle outlets 12. Furthermore, when the armature 60 is at the first armature position, at least one component of the armature assembly 59 is in contact with a stop surface. In one embodiment, the control valve member 40 may be in contact with the high-pressure conical valve seat 41, which acts as a stop surface or a stop surface located on the stator assembly. In another embodiment, the guide piece 61 may be in contact with a stop surface on the bottom stator surface 76 of the stator assembly 80.

In order to end the main injection event, the electrically actuated solenoid assembly 75 is de-energized. The solenoid assembly 75 no longer exerts a magnetic force on the armature 60 allowing the biasing spring to move the armature 60 from the first armature position to the second armature position. As the armature 60 moves towards the second armature position, the control valve member 40 moves towards the low pressure flat valve seat 42, allowing fuel to move from the nozzle chamber 19 to the needle control chamber 33 via the nozzle supply passage 18, thereby increasing pressure acting on the closing hydraulic surface 34 of the nozzle check valve 32 inside the needle control chamber 33. As the pressure is increased, the nozzle check valve 32 moves towards the closed configuration, blocking fuel to flow through the unblocked nozzle outlets 12. As the armature 60 moves from the first armature position to the second armature position inside the squish film drag gap 68, the fluid inside the squish film drag gap 68 exerts a braking force on the armature 60, causing the armature travel speed to rapidly reduce, as shown at Curve 135 in FIG. 5*a*. The injection event ends once the nozzle check valve 32 returns to the closed configuration, blocking fuel from leaving the nozzle outlets 12.

In order to initiate a post injection event, the electrical actuated solenoid assembly 75 is energized after the armature 60 returns to the second armature position during the main injection event. The post injection event is ended when the solenoid assembly 75 is de-energized, returning the armature 60 back to the second armature position. In order to perform a small post injection, the solenoid assembly 75 should be energized for a small period of time.

Figure 5A:
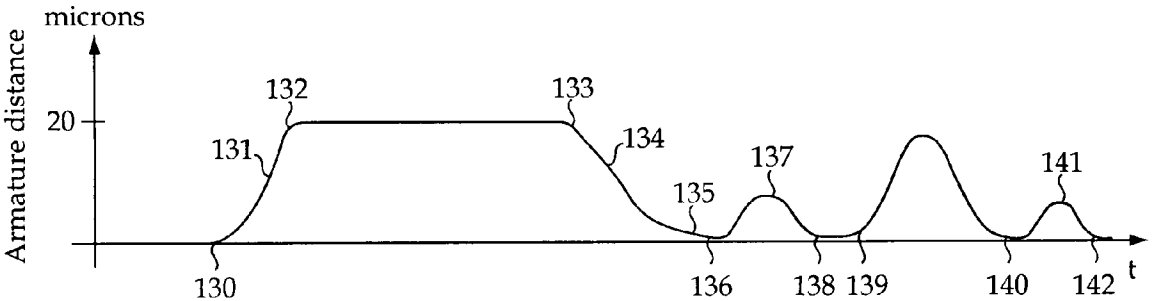
FIG. 5*a* illustrates a graph representing the armature travel displacement from the second armature position of the fuel injector shown in FIG. 1.

FIG. 5*a* illustrates a graph representing the armature travel displacement from the second armature position of the fuel injector shown in FIG. 1 of the present disclosure. Graph 92 describes the motion of the armature during the course of a main injection event followed by a small post injection event. Position 130 shows the beginning of the main injection event. The electrically actuated solenoid assembly 75 is about to be energized and the armature 60 is at the second armature position. Curve 131 signifies that the solenoid assembly 75 is now energized and the armature is moving from the second armature position to the first armature position. At some point along Curve 131 or shortly thereafter, the nozzle check valve 32 has assumed an open configuration. Position 132 signifies that the armature 60 is at the first armature position. The time between Position 130 to Position 132 is the time the armature 60 takes to move from the second armature position to the first armature position. Position 133 signifies that the solenoid assembly 75 is about to be de-energized to end the main injection event, and the armature 60 is beginning to move from the first armature position to the second armature position under the action of biasing spring 36. Curves 134 and 135 represent the armature 60 moving from the first armature position to the second armature position. The slope of the Curve 134 is steeper than the slope of the Curve 135, which means that the armature decelerates considerably more in Curve 135 than in Curve 134. When the armature 60 moves along Curve 134, the armature 60 may not be experiencing significant squish film dragging. Once the armature travels along Curve 135, the armature is subjected to substantially more squish film dragging. The fuel inside the squish film drag gap 68 along Curve 135 offers a much greater resistive force than the fuel that was inside the squish film drag gap 68 when the armature 60 was moving along Curve 134, thereby decelerating the armature 60 even more. As the squish film drag gap 68 along Curve 135 gets even smaller, the deceleration force becomes larger, and the armature 60 experiences a much stronger resistive force. The armature 60 finally reaches the second armature position when the valve member 40 of the armature assembly 59 makes contact with flat valve seat 42.

At some point along the curves 134 and 135, the nozzle check valve 32 returns to a closed configuration. Position 136 signifies the armature 60 has reached the second armature position. The time taken from Position 133 to Position 136 is the time the armature 60 takes to move from the first armature position to the second armature position.

The speed at which the armature assembly 59 contacts the flat valve seat 42 is the armature's 60 final armature travel speed. The final armature travel speed of the armature 60 in the present embodiment is much smaller than the final armature travel speed of predecessor fuel injectors. Hence, the magnitude of any resultant armature and valve bounce is much lower in the present embodiment compared to predecessor fuel injectors. Depending upon the final armature travel speed, the armature 60 may experience some, none or a lot of bouncing. The magnitude of the armature bounce may be proportional to the final armature travel speed. The bouncing occurs due to the force generated by the impact of the armature assembly 59 with the flat valve seat 42. In one embodiment, by moving the armature inside the squish film drag gap, fuel inside the squish film drag gap is squish film dragging the motion of the armature, thereby slowing the speed of the armature. As a result, the control valve member impacts the flat seat 42 at a slower speed, reducing the magnitude of bounce and thereby reducing settling time.

Position 136 represents the beginning of the settling time for the armature 60. Position 137 represents the armature bounce and Position 138 signifies the end of the armature bounce as well as the end of the settling time. The time taken from Position 136 to Position 138 is the settling time of the armature 60. If the final armature travel speed is high, the armature 60 may exhibit multiple armature bounces until it eventually reduces in speed such that it stops bouncing.

A post injection event may begin at any point after Position 136. If the post injection event begins before the armature 60 has settled, the post injection quantity and timing will be varied and less predictable. However, if the post injection event begins after the armature 60 has settled, repeated post injections will produce consistent injection quantities and injection timings. In FIG. 5*a*, the post injection begins at Position 139 and follows the same pattern as the main injection event. In order to achieve a small post injection, the duration of time for which the solenoid assembly 75 is energized is smaller, allowing the nozzle check valve 32 to remain open for a shorter period of time, thereby producing a smaller injection quantity than the main event. The armature 60 returns to the second armature position at Position 140 and experiences some armature bouncing represented by Curve 141 before settling down at Position 142. The dwell is the time between the end of the main injection event (Position 136) and the beginning of the post injection event (Position 139).

Figure 5B:
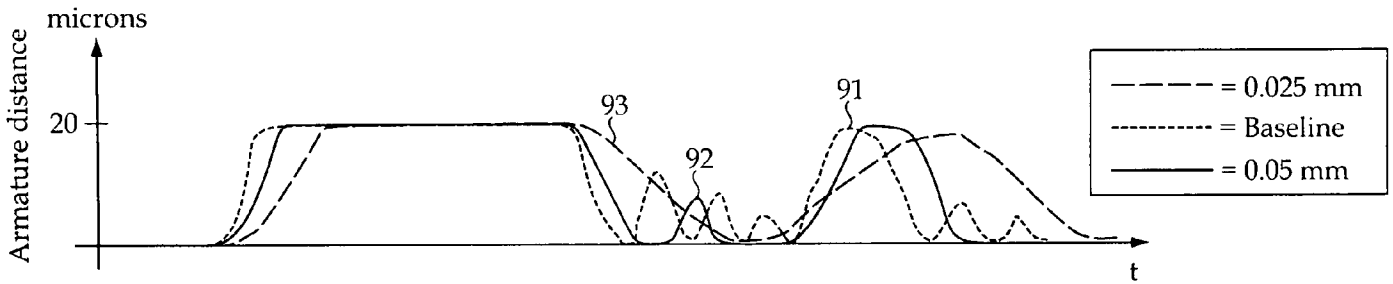
FIG. 5*b* illustrates three plots representing the armature travel displacement from the second armature position of three fuel injectors, one according to the prior art baseline, two having a having a squish film drag gap according to the present disclosure.

FIG. 5*b* illustrates three plots representing the armature travel displacement from the second armature position of three fuel injectors, each having a squish film drag gap of a different size. Graph 91 represents a predecessor fuel injector having a squish film drag gap 68 that is at least two orders of magnitude bigger than the squish film drag gap 68 of the present embodiment. Graph 92 represents fuel injector shown in FIG. 1 of the present disclosure when the final squish film drag gap 68 is set to 50 microns, which is about equal to the final air gap. Graph 93 represents another embodiment of the present disclosure where the squish film drag gap is 25 microns, which is much smaller than the final air gap.

Comparing the three graphs 91, 92 and 93, graph 91 has the smallest travel time, which illustrates that the fluid in the enlarged squish film drag gap 68 may not have affected the speed of the armature 60 as it moved between the first armature position and the second armature position. Graph 93 shows a very large travel time, which suggests that the final squish film drag gap may be so small that it reduced the armature travel speed significantly. Graph 92 had a travel time slightly larger than that of graph 91 but significantly smaller than that of graph 93.

Referring to the armature bounces shown in FIG. 5*b*, Graph 91 exhibits multiple armature bounces with a decreased magnitude in each successive bounce. The settling time for Graph 91 may also be significantly larger than the settling times of Graphs 92 and 93 (which did not have a settling time because it did not exhibit any armature bouncing). Graph 92 exhibited a smaller quantity and magnitude in armature bounce compared to Graph 91, while Graph 93 did not exhibit any bouncing and hence did not have a settling time. The total dwell time was smallest in Graph 92 and largest in Graph 93, which suggests that the squish film drag gap 68 may have a larger travel time but also reduces the time it takes to complete a main injection event. Graph 93 illustrates the effect of exposing the armature to squish film dragging throughout the entire travel distance of the armature, thereby greatly increasing the travel time of the armature. Although the settling time is minimal, the travel time is so large that the total time to perform an injection sequence is significantly larger than the time it takes the fuel injector having a final squish film drag gap of 50 microns or the predecessor fuel injector. As a result of the large travel time, Graph 93 may not be able to perform injection events producing small injection quantities or permit shortened dwell times.

In the embodiment shown in FIG. 1 and represented by Graph 92, the armature 60 experiences squish film dragging as it moves from the first armature position to the second armature position. This causes the armature 60 to slow down as it approaches the second armature position, but also reduces the settling time by reducing the magnitude of armature bounce when the control valve member 40 impacts the low-pressure flat valve seat 42.

Figure 5C:
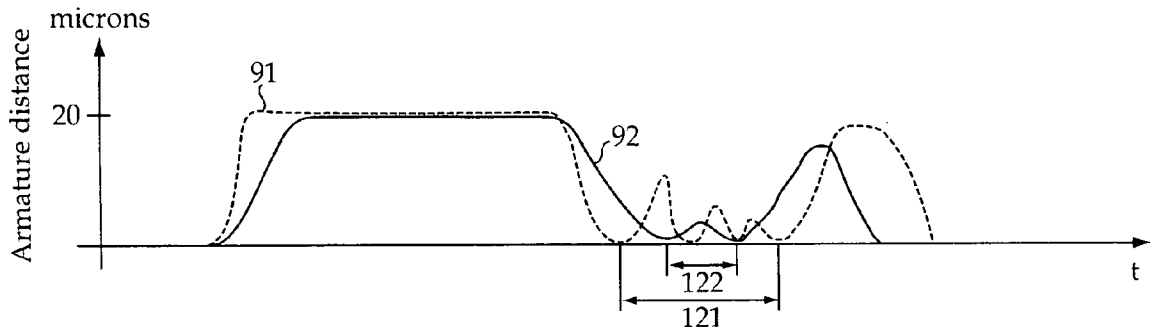
FIG. 5*c* illustrates two plots representing the armature travel displacement from the second armature position of two fuel injectors represented in FIG. 5*b*, having a different post injection event starting time.

Referring to FIG. 5*c* now, the settling times of Graphs 91 and 92 are compared. Graph 92 has a settling time 122, which is much smaller than settling time 121 of Graph 91. Furthermore, the total time the fuel injector 10 takes to perform the entire injection sequence including a main injection event and a small closely coupled post injection event is much smaller than predecessor fuel injectors represented by Graph 91. The present embodiment may allow those skilled in the art to perform consistent, close coupled post injections with shorter dwell times than predecessor fuel injectors.

Figure 6A:
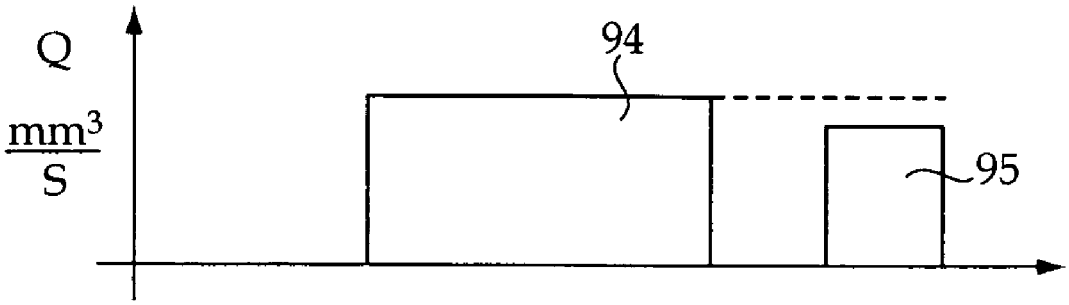
FIG. 6*a* illustrates the injection flow rate versus time for multiple injection events for a fuel injector having a squish film drag gap according to the present disclosure.
Figure 6B:
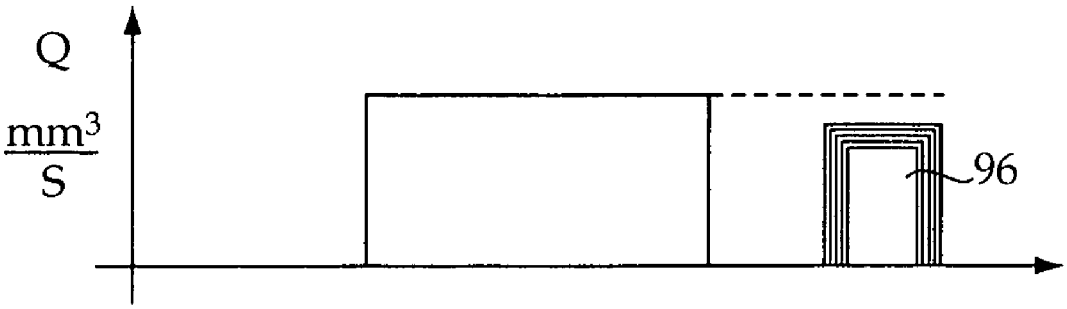
FIG. 6*b* illustrates varying injection flow rates versus time for multiple injection events for a fuel injector having a prior art baseline receiving a control signal suited for a fuel injector according to the present disclosure.

FIGS. 6*a*-*b* illustrate the injection quantities produced during a main injection event followed by a close-coupled post injection event by representative fuel injectors embodied in graphs 91 and 92, respectively when the same control signal is repeatedly sent to each of the fuel injectors represented by graphs 91 and 92. In FIG. 6*a*, the fuel injector 10 that represents graph 92 in FIG. 5 produces a consistent injection quantity that is smaller than the main injection event defined by the box 95. This is because the armature 60 is traveling between the second and first armature positions fast enough to produce a smaller injection quantity during the post injection event. The graph plots a single shape without any noticeable variations in injection quantities or timings because the dwell time is larger than the settling time 122 of the armature 60.

In FIG. 6*b*, the fuel injector that represents graph 91 in FIG. 5 produces an erratic injection quantity graph defined by box 96, with varying injection quantities and timings when receiving the same control signal as the fuel injector associated with FIG. 6*a*. The scattered lines surrounding box 96 show the erratic behavior of the close coupled post injections because the armature had not settled by the time the electrically actuated solenoid assembly 75 initiated the close-coupled post injection event. In FIG. 6*b*, the settling time 121 of the predecessor fuel injector is greater than the dwell of the control signal producing a scattered injection quantity plot.

Close-coupled post injections that are performed before the armature is settled may produce erratic injection quantities because the close-coupled post injection event may begin when the armature is already at a distance away from the second armature position. In order to perform a controlled close-coupled post injection with a high degree of accuracy and control, the controlled close-coupled post injection should begin after the armature has settled to the second armature position. The size of the injection quantity may be kept small if the armature is traveling at a fast enough armature travel speed that may move the nozzle check valve between the open and closed configuration quickly enough to only allow a small quantity of fuel to flow out through the nozzle outlets.

Therefore by reducing the size of the squish film drag gap over predecessor fuel injectors, the present disclosure allows manufacturers to design fuel injectors that produce minimum controllable injection event quantities smaller than predecessor fuel injectors with shorter dwells between injection events than ever before. On the other hand, if the gap is too small (Curve 93), then the result may be worse than the predecessor fuel injector.

People skilled in the art may choose a squish film drag gap according to specific requirements and preferences. By decreasing the squish film drag gap to a very small size, the armature travel speed throughout the armature travel distance is significantly reduced, inhibiting the ability to produce small injection quantities. Having a very large squish film drag gap may not have a strong enough squish film drag effect on the armature, thereby not reducing the armature's speed as it comes closer to the stop surface, resulting in a higher final armature travel speed and more armature bounce. The resulting settling time is larger, and therefore prevents the fuel injector's from performing consistent post injections at dwell times shorter than the settling time of the fuel injector.

People skilled in the art may recognize that adjusting the control signal of the electrical actuator will allow operators to produce consistent injection quantities as long as the dwell time is larger than the settling time of the fuel injector. Post injection events that do not require consistent post injection quantities may be performed with dwell times smaller than the settling time.

The present disclosure has the advantage of consistently achieving smaller post injection quantities 95 (FIG. 6*a*) following relatively large main injections 94 (FIG. 6*a*) with a decreased, increased or same dwell between injection events. A smaller quantity post injection 95 may achieve better emissions with only a small change to existing hardware, namely, reducing the size of the squish film drag gap between the bottom armature surface 62 and the inner surface of the injector body 11. The presence of a smaller squish film drag gap 68 also reduces the magnitude of the pressure swings that occur in needle control chamber 33 during the post-injection event, which may cause the armature assembly 59 to bounce. The smaller squish film drag gap may enhance the controllability of the post-injection event relative to predecessor fuel injectors. This enhanced controllability may also permit designers to select a dwell that may be shorter, the same or longer than what is consistently possible with the predecessor fuel injector. In summary, the increased controllability of the armature may allow for more repeated consistency in obtaining the post injection quantity 95 over the predecessor post-injection quantity, and also an improvement in the ability to select a duration for the dwell because of a reduced settling time between the injection events. The result may be better emissions reduction than an otherwise equivalent fuel system application. Those skilled in the art, however, might take note that control signals might need to be adjusted across the engine's operating range to accommodate for the slower armature travel speed of the armature at all operating conditions due to the reduced gap.

Although the present disclosure has been illustrated in the context of an injection sequence that includes a large main injection followed by a small post injection, it is foreseeable that the same techniques could be utilized to reduce the minimum controllable injection quantity of fuel injector for any injection event alone or as part of a sequence. For example, the added capabilities provided by the reduced squish film drag gap could be exploited at other operating conditions, such as to produce small split injections at idle. And in addition, smaller pilot injections may also be available via the improvement introduced in the present disclosure. Thus, the ability to incrementally decrease the minimum controllable fuel injection quantity at all operating conditions and pressures could conceivably be exploited in different ways across an engine's operating range apart from the illustrative example that included an injection sequence with a large main injection followed by a closely coupled post injection.

It should be understood that the above description is intended for illustrative purposes only, and is not intended to limit the scope of the present disclosure in any way. Those skilled in the art will appreciate that the drag phenomenon of the present disclosure can be adjusted by a number of features, including but not limited to: The relative diameter of the armature 160 to the diameter of the drag gap spacer 180, the number and size of holes 67, the OD clearance of the armature, and of course the viscosity of the fluid. Thus, those skilled in the art will appreciate that other aspects of the disclosure can be obtained from a study of the drawings, the disclosure, and the appended claims

What is claimed is:

1. A fuel injector comprising:

an injector body defining a nozzle outlet;

a solenoid assembly including a stator assembly having a bottom stator surface and an armature having a top armature surface and a bottom armature surface;

the stator assembly being closer to the top armature surface than the bottom armature surface;

an electronically controlled control valve assembly including a control valve member attached to the armature;

the armature movable between a first armature position and a second armature position inside an armature cavity partially defined by an inner surface of the injector body;

a spring biasing the armature away from the stator assembly towards the second armature position;

a final air gap being a distance between the top armature surface and the bottom stator surface when the armature is in the first armature position;

a final squish film drag gap being a distance between the bottom armature surface and an inner surface of the injector body when the armature is in the second armature position; and the final squish film drag gap being the same order of magnitude as the final air gap.

2. The fuel injector of claim 1 further includes:

an armature travel distance being defined by a distance between the first armature position and the second armature position;

the final squish film drag gap being greater than the armature travel distance.

3. The fuel injector of claim 2 wherein the final squish film drag gap is about twice the armature travel distance.

4. The fuel injector of claim 1 further includes:

a direct control nozzle check valve including a closing hydraulic surface exposed to fluid pressure in a needle control chamber, and an opening hydraulic surface exposed to fluid pressure in a nozzle chamber.

5. The fuel injector of claim 4 wherein:

the direct control nozzle check valve moves between an open configuration where the nozzle outlet is open and a closed configuration when the nozzle outlet is blocked;

a nozzle check valve travel distance being defined by a distance between the open configuration and the closed configuration;

the armature travel distance being smaller than the nozzle check valve travel distance.

6. The fuel injector of claim 4 wherein:

the needle control chamber is fluidly connected to a low pressure passage when the armature is in the first armature position; and the needle control chamber is fluidly blocked from a low pressure passage when the armature is in the second armature position.

7. The fuel injector of claim 1 wherein the squish film drag gap is partially defined by a drag gap spacer.

8. A method of operating a fuel injector comprising the steps of:

initiating an injection event by energizing a solenoid assembly to move an armature inside an armature cavity from a second armature position to a first armature position, which is a final air gap away from a bottom stator surface of a stator assembly; and ending the injection event by de-energizing the solenoid assembly to move the armature inside the armature cavity from the first armature position to the second armature position, which is a final squish film drag gap away from an inner surface of an injector body, the ending step further including a step of:

squish film dragging the motion of the armature when the armature moves from the first armature position to the second armature position, the squish film dragging step further including a step of:

setting the final squish film drag gap to the same order of magnitude as the final air gap.

9. The method of operating a fuel injector of claim 8, wherein the step of squish film dragging occurs over a distance being less than the final squish film drag gap.

10. The method of operating a fuel injector of claim 8 wherein the step of ending an injection event further includes a step of biasing the armature towards the second armature position under the action of a spring.

11. The method of operating a fuel injector of claim 8 wherein the initiating an injection event step includes the steps of:

moving fuel from a needle control chamber to a low pressure passage;

relieving pressure inside the needle control chamber; and moving a nozzle check valve from a closed configuration to an open configuration.

12. The method of operating a fuel injector of claim 8 wherein the ending an injection event step further includes a step of:

fluidly connecting a needle control chamber to a high pressure passage;

increasing pressure inside the needle control chamber; and moving the nozzle check valve from an open configuration to a closed configuration.

13. The method of operating a fuel injector of claim 8 further includes the steps of:

initiating a post injection event by energizing the solenoid assembly to move the armature from the second armature position to the first armature position inside the armature cavity after the step of ending an injection event; and ending the post injection event by de-energizing the solenoid assembly to move the armature from the first armature position to the second armature position inside the armature cavity.

14. The method of operating a fuel injector of claim 13 wherein the step of squish film dragging the motion of the armature slows the motion of the armature but reduces settling time by reducing the magnitude of bounce of a control valve member impacting a flat seat.

15. The method of operating a fuel injector of claim 8 wherein the step of initiating an injection event includes a step of squish film dragging the motion of the armature when the armature moves from the second armature position to the first armature position.

16. The method of operating a fuel injector of claim 8 further includes setting a final squish film drag gap by selecting a drag gap spacer having a pre-determined thickness.

17. A fuel system, comprising:

a rotatable cam;

a mechanical electronic unit fuel injector actuated via rotation of the cam, the mechanical electronic unit fuel injector including;

an injector body defining a nozzle outlet;

a first electrical actuator operably coupled to a spill valve;

a second electrical actuator operably coupled to control pressure in a needle control chamber;

a solenoid assembly including a stator assembly having a bottom stator surface and an armature assembly having a top armature surface and a bottom armature surface;

the stator assembly being closer to the top armature surface than the bottom armature surface;

an electronically controlled control valve assembly including a control valve member attached to the armature;

the armature movable between a first armature position and a second armature position inside an armature cavity partially defined by an inner surface of the injector body;

a spring biasing the armature towards the second armature position;

a final air gap being a distance between the top armature surface and the bottom stator surface when the armature is in the first armature position;

a final squish film drag gap being a distance between the bottom armature surface and an inner surface of the injector body when the armature is in the second armature position; and the final squish film drag gap being the same order of magnitude as the final air gap.

18. The fuel system of claim 17 further includes:

an armature travel distance being defined by a distance between the first armature position and the second armature position;

the final squish film drag gap being greater than the armature travel distance.

19. The fuel system of claim 18 wherein the final squish film drag gap is about twice the armature travel distance.

20. The fuel system of claim 17 wherein the squish film drag gap is partially defined by a drag gap spacer.

* * * * *